US005238319A

United States Patent [19]

Lucas

[11] Patent Number: 5,238,319

[45] Date of Patent: Aug. 24, 1993

[54] PRODUCT APPLICATOR CASE WITH ACTIVATING BUTTON AND BLOCKING COVER

[75] Inventor: Marthe Lucas, La Grande Motte, France

[73] Assignee: Societe de Conseils et d'Etudes des Emballages (SCEE) (S.A.), Soisy Sous Montmorency, France

[21] Appl. No.: 883,165

[22] Filed: May 15, 1992

[30] Foreign Application Priority Data

May 17, 1991 [FR] France ..... 91 06026

[51] Int. Cl.[5] ..... A45D 40/02

[52] U.S. Cl. ..... 401/59; 401/60

[58] Field of Search ..... 401/59, 60

[56] References Cited

U.S. PATENT DOCUMENTS 2,064,555 12/1936 Mitchell .
2,064,557 12/1936 Lee .
2,165,632 7/1939 Hoffman .
4,723,858 2/1988 Zinnbauer ..... 401/60

FOREIGN PATENT DOCUMENTS 648013 7/1937 Fed. Rep. of Germany .
795516 3/1936 France .
850568 12/1939 France .
944022 3/1949 France .
950889 10/1949 France ..... 401/59
1491052 12/1965 France .
387746 2/1933 United Kingdom ..... 401/60

*Primary Examiner*—Steven A. Bratlie
*Attorney, Agent, or Firm*—Sandler Greenblum & Bernstein

[57] ABSTRACT

Product applicor case provided with an external sheath and a support for the product. The support is slidably mounted in the sheath and is connected to an external activating button, adapted to enable the support to slide in the same direction as the button, to push out or retract the product in the sheath through an opening. The opening is blockable by a blocking cover connected to the button and to the support. A guide sleeve is mounted in the external sheath and forms a guide for the blocking cover, which is formed by a flexible plate-shaped member connected to the support by two lateral tongues that form a free space between each other forming a passage for the product and at the same time enables the opening of the external sheath to be released when the plate-shaped member disappears by sliding.

20 Claims, 2 Drawing Sheets

14
5
2
22
3
18
11
10
9
23
7
4
15d
19
20
9'

2b
2
2c
2a
7
20
14
2d 1
18
2
2a
9
8

F3
IV
7
2
2a
9
IV
14
8
19

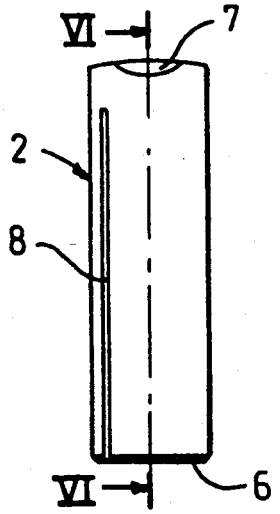
FIG.5
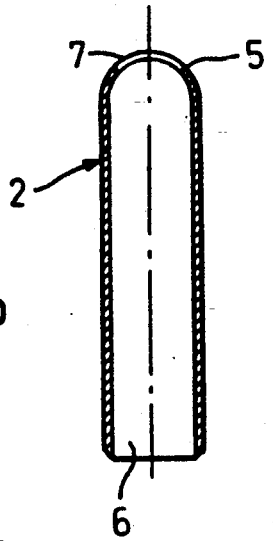
FIG.6
FIG.7
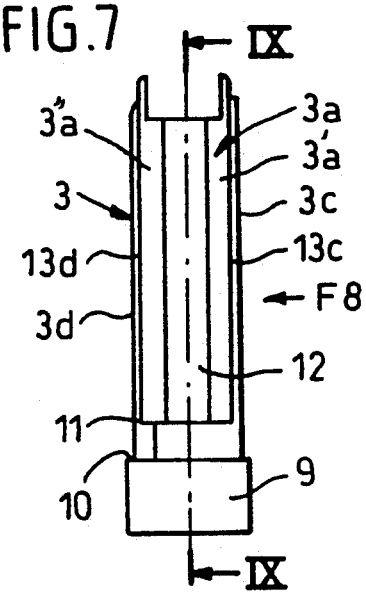
FIG.8
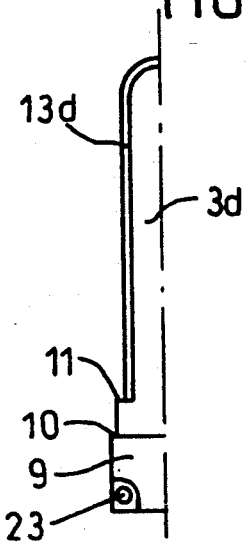
FIG.9
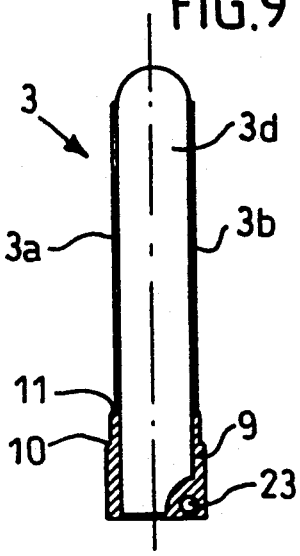
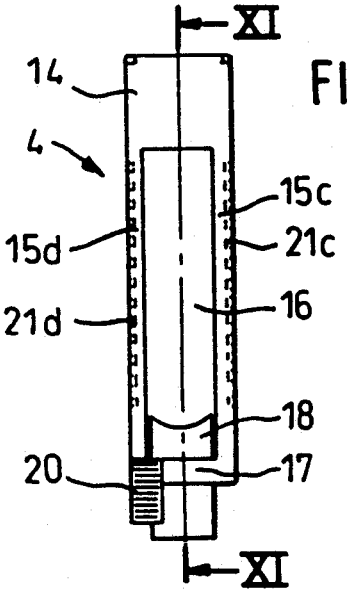
FIG.10
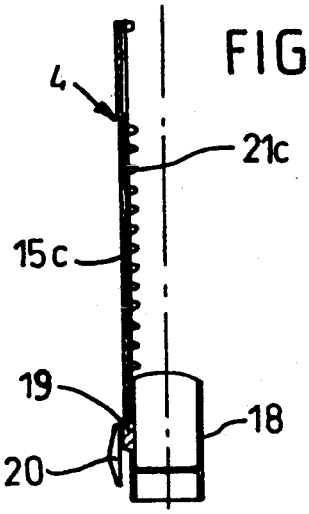
FIG.11

PRODUCT APPLICATOR CASE WITH ACTIVATING BUTTON AND BLOCKING COVER

Field of the Invention

The invention relates to a product applicator case with an activating button and a blocking cover. More specifically, the present invention is adapted to provide an applicator for solidified products shaped like sticks, such as cosmetic products (lipsticks, lip protectors) or other products with a similar appearance (glue, and maintenance or cleaning products). The present invention is also related to a number of other products, such as makeup pencils or similar products.

Background of the Invention

Among the various applicator devices or dispensers for stick-shaped products, which products are generally solidified, there are those applicator devices that comprise an external sheath having a support for the product. The support is slidably mounted and connected to an external activating button adapted to obtain the sliding of the support, so that the product can be pushed out or retracted, respectively, through an opening in the sheath. The opening can be blocked by a blocking cover connected to the button and to the support.

Among conventional product dispensers, some possess mechanical configurations that permit the product to be driven along an inverse direction with respect to the direction in which the button is activated, i.e., sliding of the button in one direction achieves the sliding of the product in the other direction. Such a device is described in French patent FR-A1,491,052, the disclosure of which is incorporated by reference in its entirety.

There are also some devices that usually have a much more complicated mechanical structure, which structure enables the support of the product to slide in the same direction as the activation of the button. Devices of this type are described in FR-A-795,516, DE-C-648,013, and FR-A-850,568, the disclosures of which are incorporated by reference in their entirety.

SUMMARY OF THE INVENTION

It is an object of the present invention to provide a device of the type which structure enables the support of the product to slide in the same direction as the activation of the button.

Further, the applicator according to the present invention has the advantages of being easy to manufacture, being inexpensive and having great functional flexibility.

An applicator according to the invention is provided with a guide sleeve mounted in a sheath in which the product support slides, and the guide sleeve externally forms a guide for a blocking cover which is formed by a flexible plate-shaped member connected to the support by two lateral tongues, that arrange a free space therebetween. The free space forms a passage for the product and at the same time enables the opening of the sheath to be uncovered when the plate-shaped member disappears by sliding.

Advantageously, the sleeve has guiding surfaces for the plate-shaped member and the tongues. The tongues which slide in a space arranged between the surfaces and the internal walls of the external sheath, and are provided with teeth or serrations that take support on the guiding surface of the sleeve. Preferably, the teeth or serrations are arranged on the external edge of the tongues and extend in a perpendicular direction with respect to these towards the sleeve. Also, the guiding surfaces of the sleeve for the teeth or serrations can be formed by grooves that provide lateral contact surfaces and possibly end contact surfaces for the teeth or serrations.

According to one embodiment, the tongues are connected to each other, at ends opposite to that of the blocking plate-shaped member, by a transverse bar affixed by a connecting element of the product support. Further, the sleeve has a longitudinal slot for the passage of the connection element between the bar and support. Preferably, in this case, the external sheath generally has a parallelepiped-shaped appearance, with the activating button being located laterally on one of the walls of the sheath, in the vicinity of the bar. The button can slide by means of a longitudinal slot in the sheath arranged laterally on the wall.

The blocking plate-shaped member, the lateral tongues, the product support, the bar that connects the tongues and the activating button can be constructed as a single piece, i.e., as a single, unitary member.

In one embodiment according to the invention, the guide sleeve is affixed to a base that shuts the sheath after introduction of the sleeve in the sheath and in this case, the sliding space between the sleeve and the sheath is ensured by a shoulder of the base of the sleeve.

In another manner of describing the invention, a product applicator device is provided which includes an external sheath including an opening; a support for product slidably mounted with said sheath; and an external activating button. The support and the button are connected so that the support is slidable in a same direction as the button to push out or retract product through the opening. A guide sleeve is mounted in the external sheath, a blocking element is provided which comprises a flexible plate-shaped member connected to the support for blocking the opening, and two lateral tongues forming a free space therebetween defining a passage for product, and the blocking element is constructed and arranged to be guidance along an external portion of the guide sleeve in association with movement of the button to unblock the opening.

The above-described product applicator device can include any of the previously described features in conjunction therewith.

BRIEF DESCRIPTION OF THE DRAWINGS

The invention will be better understood and other special characteristics will become clearer upon reading the description that follows with reference to the annexed drawings, in which:

FIG. 5 is a front view of the external sheath of the case;

FIG. 6 is a sectional view taken along VI—VI of FIG. 5;

FIG. 7 is a front view of the guide sleeve of the case;

FIG. 8 is a lateral, half view along arrow F8 of FIG. 7;

FIG. 9 is a sectional view taken along IX—IX of FIG. 7,

FIG. 10 is a front view of the element forming, among other things, the blocking cover; and FIG. 11 is a sectional view taken along XI—XI of FIG. 10.

DETAILED DESCRIPTION OF THE PREFERRED EMBODIMENTS

Figures 1, 2, 3, 4:
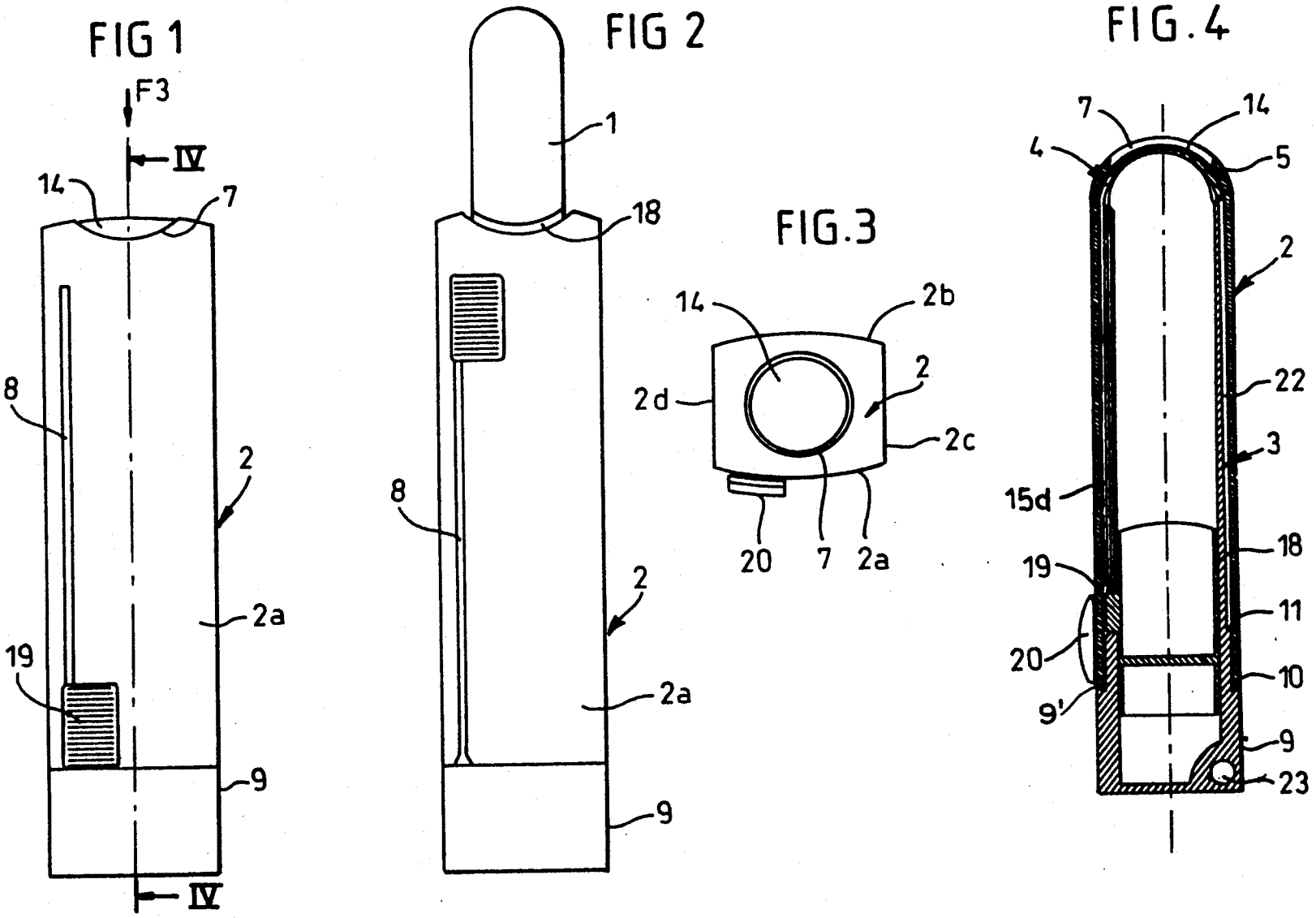
FIG. 1 shows an applicator case according to the invention, in a closed position.
FIG. 2 shows the applicator case of FIG. 1 in an open
FIG. 3 is a top view along arrow F3 of FIG. 1.
FIG. 4 is a sectional view taken along IV—IV of FIG. 1.

The embodiment represented especially concerns an applicator case for a solidified product shaped like a stick, such as a cosmetic product, including, but not limited to, lipstick or lip protector, represented by reference numeral 1 in FIG. 2.

The case according to the invention basically comprises three elements, including an external sheath 2 (FIGS. 1–6), a guide sleeve 3 (FIGS. 4 and 7–9), and an element 4 (FIGS. 4, 10 and 11) adapted to basically constitute a blocking cover, as will be explained hereinafter. The elements can be constructed from various materials of construction, and can be, for example, made of molded plastic.

Sheath 2 is represented as a substantially parallelepiped-shaped tube whose two opposing walls, respectively called front wall 2*a* and rear wall 2*b* (FIG. 3), however, bulge slightly; whereas, the other two lateral walls 2*c* and 2*d* are substantially planar. Although, walls 2*c* and 2*d* are substantially planar each has a rounded shape 5 at its upper end (FIGS. 4 and 6).

As illustrated in FIG. 6, the tube forming the sheath has at its base an opening 6 that completely opens it, and a circular opening 7 arranged at its other end for passage of the product, as will be explained hereinafter.

Because of the rounded shape 5 of the lateral walls 2*c* and 2*d*, it is understood that around opening 7, walls 2*a* and 2*b* are also joined to each other by a rounded part.

As can also be seen in FIGS. 1–6, the front face 2*a* of sheath 2 has a longitudinal slot 8 arranged laterally.

Sleeve 3 of FIGS. 4 and 7–9 has an external shape that corresponds to the internal shape of sheath 2 in which it must be introduced with clearance for reasons that will be discussed hereinafter, and comprises a front wall 3*a*, a rear wall 3*b* and two lateral walls 3*c* and 3*d*.

The upper portion of sleeve 3 is completely open; whereas, its lower portion is closed by a base 9 with a flat bottom, arranging two successive, graduated shoulders respectively 10 and 11 (FIGS. 4 and 7, 8, 9).

Furthermore, the lateral walls 3*c* and 3*d*, as is shown in the drawings, have an upper rounded end such as those of sheath 2, which also project with respect to front wall 3*a* and rear wall 3*b*.

The front wall 3*a* is also provided with a board longitudinal and median slot 12 that separates the wall into two by forming two surfaces respectively 3'*a* and 3''*a*.

It must also be noted that the lateral walls 3*c* and 3*d* are each provided with a peripheral groove 13*c*, 13*d*, resulting, for example, from an excess thickness of the central portion of the lateral walls, and whose shape, due to the shape of the lateral walls, is substantially that of a hair pin.

The third element 4 that completes the device according to the invention, is especially visible in FIGS. 4, 10 and 11.

Element 4 comprises a flexible plate-shaped member 14 which is extended laterally by two tongues 15*c*, 15*d*, also flexible, that arrange a space 16 between each other, and that are connected at their ends by a bar 17. The bar 17 is connected on one side to a tubular support 18 shaped like a cup, for example, by a connecting portion 19, and on the other side (arranged laterally in this example) by an activating button 20.

Tongues 15*c* and 15*d* and possibly plate-shaped member 14 are provided with teeth or serrations 21*c* and 21*d*. In particular, each tongue 15*c* and 15*d* comprises a series of teeth or serrations 21*c* and 21*d* that are arranged as represented in the drawings, on the external edge of the tongues and they extend perpendicularly to these beside support 18 (in FIG. 10, the teeth or serrations are not visible except possibly by transparency).

The assembly of the device is simple. Element 4 is placed in sleeve 3, so that support 18 is positioned inside sleeve 3, and tongues 15*c* and 15*d* are positioned outside sleeve 3. The connection lug 19 passes through slot 12 of sleeve 3. Element 4 can be made to slide up until bar 17 comes into contact with shoulder 11 of the sleeve. In this position, tongues 15*c* and 15*d* take support on surfaces 3'*a* and 3''*a*; whereas, teeth or serrations 21*c* and 21*d* take lateral support, possibly by their edges in grooves 13*c* and 13*d*.

The assembly can then be introduced via opening 6 into the sheath 2. In particular, the flexible plate-shaped member 14 is capable of being rounded to conform to the corresponding rounded portions 5 of the sleeve and of the sheath. Also, the material that attaches button 20 to the bar can slide in slot 8 of the sheath 2.

Sleeve 3 is introduced up until its shoulder 10 comes into abutment with the corresponding end of the sheath 2. As illustrated in FIGS. 4 and 4–9, a small lip on the sheath 2 abuts an end of the sleeve 3, and is capable of being introduced in a small corresponding groove 9' of base 9; whereas, the two elements 3 and 4 may be connected together, for example, by ultrasonic welding.

Also, illustrated in FIG. 4, shoulder 11 enables a space 22 to be arranged between sleeve 3 and sheath 2 in which the plate-shaped member 14 is housed and is capable of sliding, as will tongues 15*c*, 15*d* and bar 17.

The dimensions of the elements are chosen in such a way that the plate-shaped member 14 blocks opening 7 of the sheath 2, when the device is in the position shown in FIGS. 1 and 4.

It is understood that by enabling button 20 to slide thereafter upwardly in slot 8, tongues 15*c* and 15*d* and plate-shaped member 14 are perfectly guided in space 22 between elements 2 and 3 and especially by the surfaces 3'*a*, 3''*a*, wall 3*b* and the internal walls of the sheaths, grooves 3'*a*, 3''*a* acting as rails for teeth or serrations 21*c*, 21*d*. In this way, as the activating button 20 is pushed upwardly, the plate-shaped member is pushed beyond opening 7, whereby the plate-shaped member 14 disengages from the opening. Simultaneously, support 18 rises in sleeve 3. Thus, product 1 (not represented in FIG. 4) can project from sheath 2, as is shown in FIG. 2, by passing through space 16 between tongues 15*c* and 15*d* and through opening 7.

During actual assembly, it is understood that product will be introduced into the device in the position of the device illustrated in FIG. 2, so that product 1 can be introduced into support 18.

It is clear that an inverse sliding will enable product 1 to re-enter the case and to block opening 7 by the plate-shaped member 14.

Variations or modifications can of course be envisioned without leaving the scope of the invention. For example, button 20 and slot 8 can naturally be located on the other side of the bar, or even in the middle.

Furthermore, support 18 and sheath 2 can advantageously be provided with guiding ribs and grooves.

Base 9 can advantageously, as represented, be flat to enable the case to remain upright, according to the invention, or it can also, as represented, comprise a gripping or suspending element, such as opening 23 (FIGS. 4, 8, 9).

This application is related to French Application No. 9106026, filed May 17, 1991, whose priority is claimed, the disclosure and drawings of which are incorporated by reference thereto in their entirety.

Numerous variations may be envisioned without departing from the object of the invention, and the invention is not limited to the specifically disclosed embodiments.

What is claimed:

1. Product applicator device, comprising:

an external sheath including an opening;

a support for product slidably mounted within said sheath;

an external activating button;

said support and said button being connected so that said support is slidable in a same direction as the button to push out or retract product through said opening;

a guide sleeve mounted in said sheath; and an elongated member connected to said support comprising two lateral tongues forming a free space therebetween defining a passage for product and a blocking member comprising a flexible plate-shaped member having one end connected to said two lateral tongues and a free end opposite said end connected to said two lateral tongues, and said elongated member being constructed and arranged to be guidance along an external portion of said guide sleeve in association with movement of said button to unblock said opening.

2. Device according to claim 1, wherein said guide sleeve comprises guiding surfaces for said plate-shaped member and said two lateral tongues.

3. Device according to claim 2, comprising a sliding space formed between said guiding surfaces and internal walls of said sheath, and said two lateral tongues are slidable in said space.

4. Device according to claim 2, wherein said two lateral tongues include serrations that are supported on said guiding surface of said guide sleeve.

5. Device according to claim 3, wherein said two lateral tongues include serrations that are supported on said guiding surface of said guide sleeve.

6. Device according to claim 4, wherein said serrations are located on an external edge of each of said two lateral tongues, and perpendicularly extend with respect to said guiding sleeve.

7. Device according to claim 6, wherein guiding surfaces for said serrations comprise grooves providing lateral support for said serrations.

8. Device according to claim 7, wherein said guiding surfaces for said serrations further provide end contact guiding surfaces for said serrations.

9. Device according to claim 1, wherein said two lateral tongues are connected to each other on an end opposite from said plate-shaped member by a transverse bar, said transverse bar is affixed to said support by a connection member, and said guide sleeve includes a transverse slot for passage of said connection member.

10. Device according to claim 3, wherein said two lateral tongues are connected to each other on an end opposite from said plate-shaped member by a transverse bar, and said transverse bar is affixed to said support by a connection member.

11. Device according to claim 5, wherein said two lateral tongues are connected to each other on an end opposite from said plate-shaped member by a transverse bar, and said transverse bar is affixed to said support by a connection member.

12. Device according to claim 6, wherein said two lateral tongues are connected to each other on an end opposite from said plate-shaped member by a transverse bar, and said transverse bar is affixed to said support by a connection member.

13. Device according to claim 9, wherein said sheath is substantially parallelepiped-shaped and includes a longitudinal slot laterally arranged on its wall, and said button is slidably positioned through said longitudinal slot.

14. Device according to claim 10, wherein said sheath is substantially parallelepiped-shaped and includes a longitudinal slot laterally arranged on its wall, and said button is slidably positioned through said longitudinal slot.

15. Device according to claim 13, wherein said plate-shaped member, said two lateral tongues, said support, said transverse bar and said button comprise one-piece.

16. Device according to claim 14, wherein said plate-shaped member, said two lateral tongues, said support, said transverse bar and said button are of one piece construction.

17. Device according to claim 3, wherein said guide sleeve is affixed to a base that closes said sheath after introduction of said guide sleeve into said sheath.

18. Device according to claim 16, wherein said guide sleeve is affixed to a base that closes said sheath after introduction of said guide sleeve into said sheath.

19. Device according to claim 17, wherein said sliding space between said guiding sleeve and said sheath is ensured by a shoulder of said base.

20. Device according to claim 18, wherein said sliding space between said guiding sleeve and said sheath is ensured by a shoulder of said base.

* * * * *